US008028753B2

(12) United States Patent
Shaw et al.

(10) Patent No.: US 8,028,753 B2
(45) Date of Patent: Oct. 4, 2011

(54) SYSTEM, METHOD AND APPARATUS FOR CONTROLLING THE FLOW RATE OF AN ELECTRICAL SUBMERSIBLE PUMP BASED ON FLUID DENSITY

(75) Inventors: Chris K. Shaw, Tulsa, OK (US); Donn J. Brown, Broken Arrow, OK (US); Earl B. Brookbank, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 237 days.

(21) Appl. No.: 12/042,373

(22) Filed: Mar. 5, 2008

(65) Prior Publication Data

US 2009/0223662 A1 Sep. 10, 2009

(51) Int. Cl.
*E21B 43/00* (2006.01)
*E21B 43/12* (2006.01)

(52) U.S. Cl. ..... 166/369; 166/53; 166/68; 166/105

(58) Field of Classification Search ..... 166/250.15, 166/53

See application file for complete search history.

(56) References Cited

U.S. PATENT DOCUMENTS

| | | | | |
|---|---|---|---|---|
| 6,167,965 | B1 * | 1/2001 | Bearden et al. | 166/250.15 |
| 6,367,547 | B1 | 4/2002 | Towers et al. | |
| 6,604,581 | B2 | 8/2003 | Moake et al. | |
| 6,631,762 | B2 | 10/2003 | Collette | |
| 7,114,557 | B2 | 10/2006 | Cudmore et al. | |
| 7,343,970 | B2 * | 3/2008 | Lopez de Cardenas et al. | 166/250.07 |
| 7,380,608 | B2 * | 6/2008 | Geier | 166/369 |
| 7,530,392 | B2 * | 5/2009 | Sugiyama et al. | 166/263 |
| 2009/0056939 | A1 * | 3/2009 | Hackworth et al. | 166/265 |
| 2009/0223662 | A1 * | 9/2009 | Shaw et al. | 166/250.15 |
| 2009/0242197 | A1 * | 10/2009 | Hackworth et al. | 166/250.01 |

* cited by examiner

*Primary Examiner* — Jennifer H Gay
(74) *Attorney, Agent, or Firm* — Bracewell & Giuliani LLP

(57) ABSTRACT

An electrical submersible pump that regulates pump flow rate based on sensor measurements of the fluid is disclosed. The sensor measures a property of the fluid being processed. The sensor may be located at the intake, discharge or other area of the pump. The sensor measures the relative proportion of gas in the pumped liquid. The pump flow rate is adjusted to maintain a desired level for the gas in a production environment. The pump may be used to operate and control a seabed gas-liquid separation and centrifugal pump system.

20 Claims, 6 Drawing Sheets

SYSTEM, METHOD AND APPARATUS FOR CONTROLLING THE FLOW RATE OF AN ELECTRICAL SUBMERSIBLE PUMP BASED ON FLUID DENSITY

BACKGROUND OF THE INVENTION

1. Technical Field

The present invention relates in general to electrical submersible pump assemblies and, in particular, to an improved system, method, and apparatus for controlling the flow rate of an electrical submersible pump based on measurements of at least one physical property of the fluid being produced.

2. Description of the Related Art

The separation of gases and liquids carried out in a well bore is common. In addition, separation of gasses and liquids at the seabed as part of a subsea oilfield exploitation is becoming increasingly common. Separating the gas and using a high head centrifugal pump to pump the liquids vastly improves the project economics (e.g., asset net present value and recovery factor). The separation of the gas from the liquid also results in improved flow assurance. Moreover, pumping fluids that contain excessive amounts of gas can cause gas lock in a pump or can cause a pump to overheat and fail prematurely.

Currently, in a well bore, the accepted method of controlling the gas-liquid interface level is to manually control the amount of fluid produced by a down hole electric submersible pump (ESP). Generally, the ESP is installed and the production rate is set. If the pump encounters a gas lock condition, it is shut down to allow the well to recover, restarted and a new lower production rate is manually set. This is continued until the ESP is operating in a continuous and stable manner. Conversely, if the pump does not gas lock when the ESP is first installed and is operating in a stable manner, the production rate is manually increased in steps until a gas lock condition occurs. After recovery, the production rate is then reduced to the point of the last stable operation. The object is to produce the maximum fluid available from the well with the pumping equipment.

In surface or subsea canned boosters, the methods for measuring and controlling the gas-liquid interface level is insufficient. In one type of installation, pressure transducers are used to infer, rather than measure, the interface level based on the pressures of the fluids at given elevations in the can or vessel. This method requires a significant difference in height between the transducers to achieve the required resolution in a high pressure vessel. Consequently, oversized and more expensive pressure vessels are used to enable this method. While this solution is satisfactory for some applications, an improved method to monitor fluid parameters and optimize pump performance would be desirable.

SUMMARY OF THE INVENTION

Embodiments of a system, method, and apparatus for regulating the flow rate of a pump in an electrical submersible pump assembly according to sensor measurements are disclosed. The sensor may comprise a fluid property measurement device that detects a property, such as density or capacitance, of the fluid being produced. The sensor may be located at the intake, discharge or other areas of the assembly. The sensor measures the relative proportion of gas in the liquid by the change in the property being measured. The pump flow rate, such as pump speed, may be adjusted to maintain a constant level for the gas in a production environment.

The invention is particularly well suited for operation and control of a seabed gas-liquid separation and centrifugal pump system. This design actually controls the flow rate of the pump rather than the trial and error method of merely monitoring the fluid levels inside a production vessel. Detecting the discharge fluid property that is affected by gas content enables the well or production vessel to be operated for more efficient production. One of the primary concerns for such operations is to maintain liquid-free gas. Maximizing the free volume inside the vessel maximizes the gas quality. Control of the pump flow rate according to a known level of entrained gas maintains the gas-liquid level at its lowest possible level, thereby maximizing the gas separation volume.

For example, an intake flow path to the pump may be provided by a motor shroud with the pump located below perforations in the well. The pump receives the fluid intake from the lower open end of the shroud which allows the gas to move up the well between the casing and the discharge tube and out the casing vent at the surface. Alternatively, the intake flow path may use an inverted shroud that directs the flow up past the ESP. The fluid is then directed down inside the inverted shroud while the gas moves up the well between the casing and discharges out of the casing vent at the surface.

In another embodiment, the intake flow path is in a canned pump where the flow of both oil and gas enters at the top of the can. The ESP is in the can with a shroud to direct the fluid down and past the motor. The gas separates out of the fluid, travels to the top of the can where it is routed to surface processing facilities. The flow rate of the ESP is regulated using a controller and a sensor that measures the amount of gas going to the intake of the pump.

The sensor measures the fluid density or other fluid properties that are related to the amount of gas in the fluid. When the fluid contains more gas than desired by the controller set point, the pump flow rate is reduced to allow more time for the gas to separate and bypass the pump intake. If there is less gas in the fluid than desired, the pump flow rate is increased to allow less time for separation. One object of the invention is to produce the maximum amount of fluid without gas locking the pump.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
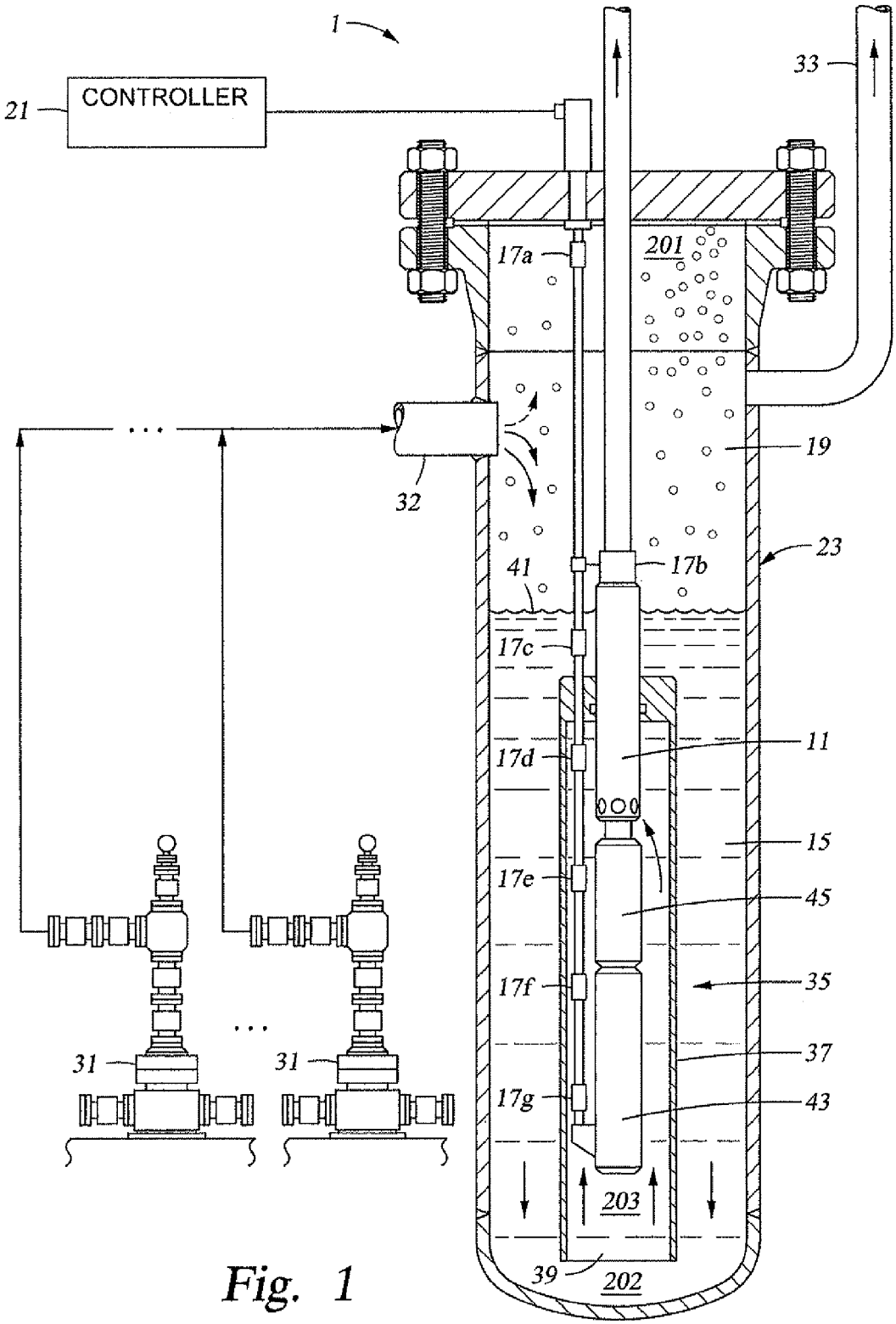
FIG. 1 is a schematic diagram of one embodiment of an electrical submersible pump assembly for a production system and is constructed in accordance with the invention.

Referring to FIGS. 1-6. embodiments of a system, method and apparatus for regulating the fluid flow rate of a pump according to sensor measurements are disclosed. The pump may comprise a centrifugal pump in an electrical submersible pump (ESP) assembly, a sucker rod pump, a hydraulic pump, or any kind of pump as well as an ESP. The ESP pumps a gassy fluid in a well or production vessel with the intake flow to the pump routed in such a way that the gas substantially separates from the oil and is not drawn into the pump. Means are provided to remove the gas to gas processing facilities located at the surface.

In a basic embodiment (FIG. 1), the invention comprises a system 1 for controlling a pump 11 in a well or other type of gas-oil separation and production environment, such as a production vessel 23 (e.g., a caisson, canned pump assembly, booster pump assembly, etc.). The production vessel 23 is the sealed vessel that contains the oil to be pumped to the surface. The system 1 uses the pump 11 to retrieve fluid 15 from the production vessel 23.

One or more instruments or sensors 17*a*-17*g* are located adjacent the pump 11 to obtain physical property measurements of the fluid 15. Physical properties such as density, capacitance, etc., that are influenced by the presence of a gas are suitable for these applications. For example, the rotational speed of a turbine flow meter is directly proportional to the gas content in fluid. Although the sensor 17*b* is shown located at the fluid discharge area 201 (i.e., after gas separation) of the pump, it also may be located at a fluid intake area 202 relative to the pump, or at any position along the assembly. In addition, the sensor 17 may comprise a plurality of sensors 17*a*-17*g* located at different positions along the fluid flow path 203 relative to the assembly.

In one embodiment, density measurements may be used as an indicator of the relative proportion of gas 19 in the fluid 15. A controller 21 coupled to the sensor 17 controls the flow rate of the pump 11. The flow rate of the pump 11 is modified responsive to the density measurements in order to maintain a desired constant or set point level of gas within the production vessel 23. The desired level of gas within the vessel may be selected based on many criteria and depends on the application. For example, in one embodiment, the set point level may be established at or near the pump intake to provide the maximum gas volume and the maximum gas liquid separation prior to producing the fluid to the surface.

As shown in the embodiment of FIG. 1, the invention is employed in an oil and gas production system comprising a plurality of wells 31 for producing oil and gas. The production vessel 23 may be provided with an inlet pipe 32 for fluid communication with the plurality of wells 31. The production vessel 23 contains a volume of oil 15 and a volume of gas 19 produced by the plurality of wells. The production vessel 23 has a gas port 33 for releasing the gas 19.

An ESP assembly 35 is located in a shroud 37 and installed in the production vessel 23 for pumping oil 15 out of the production vessel 23. The shroud 37 has an opening 39 on a lower end thereof that is submerged beneath an interface 41 between the volumes of oil 15 and gas 19. Shroud 37 serves as a means for separating gas from well fluid flowing to ESP assembly 35. The ESP assembly 35 comprises a motor 43, a seal section 45 and the pump 11, and may include a gas separator. The sensor 17 measures a property (e.g., density) of the fluid processed by the ESP assembly 35. The controller 21 controls the flow rate of pump 11 in response to the sensor 17.

As described herein, the flow rate of the pump 11 may be modified responsive to the fluid density measurements to maintain a desired level 41 of gas within the production vessel 23. The fluid density indicates a relative proportion of gas in the oil. The sensor 17 may be located at the fluid discharge or fluid intake areas relative to the pump. In alternate embodiments, the sensor 17 may comprise multiple sensors located at different positions along a fluid flow path relative to the ESP assembly 35. Such sensors may sense or measure more than one property of the fluid.

The automated flow rate control of the pump may be manipulated by, e.g., modifying the speed of the pump. Alternatively, a choke 205 (e.g., discharge choke valve) may be provided in the fluid flow path downstream from the pump to regulate the flow rate of fluid through the pump. See system 2 and other embodiments having a choke 205 in FIGS. 4-6.

The invention also comprises a method for controlling a pump. In one embodiment, the method comprises the steps of installing a pump in a production vessel, the pump having a fluid intake located in a shroud; receiving fluid comprising oil and gas into the production vessel and pumping the fluid out of the production vessel with the pump; sensing a property of the fluid being pumped, the property being a measurement of a relative proportion of gas in the oil; and modifying a flow rate of the pump in response to the property measurements to maintain a desired level of gas within the production vessel.

In still other embodiments, the pump flow rate is controlled based on the density of the gas outlet stream (i.e., inversed) as measured by a gas density sensor suitable for the environment. A liquid density sensor for in-well use also may be used.

Figure 2:
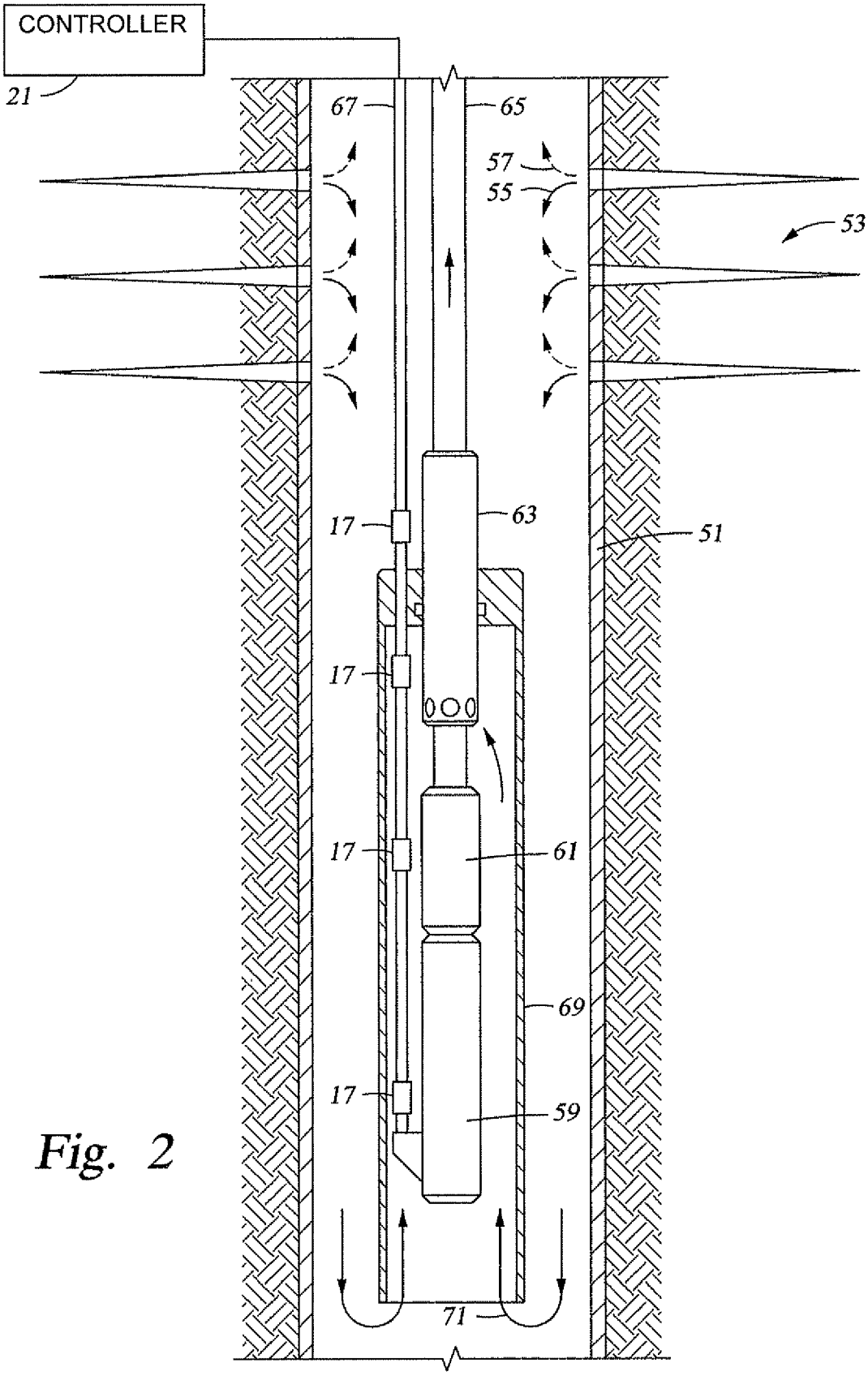
FIG. 2 is a schematic diagram of another embodiment of an electrical submersible pump assembly for a production environment and is constructed in accordance with the invention.

Referring now to FIG. 2, another embodiment of an electrical submersible pump assembly for a production environment is shown. In this embodiment, a well having well casing 51 with perforations 53 permits a liquid flow 55 and gas flow 57. The ESP assembly includes a motor 59, seal 61 and pump 63, which are mounted to a discharge tube or outlet pipe 65, and power is provided via power cable 67. The ESP assembly is located below perforations 53.

In addition, at least a portion of the ESP assembly is located in a motor jacket or shroud 69. The intake flow path 71 of liquids 55 to the pump 63 is defined by the shroud 69. The pump 63 receives the fluid intake 71 from the lower open end of the shroud 69. In the embodiment shown, the shroud 69 is sealed and mounted to the pump 63, it extends downward past the pump, and it is open at a lower end thereof. This configuration allows the gas 57 to move up the well between the casing 51 and the outlet pipe 65 and out the casing vent at the surface.

The shroud 69 also directs flow past the motor 59 for cooling purposes. In another embodiment, some of the fluid being produced by the pump 63 is directed down the well so that it flows past the motor 59 for cooling purposes. In embodiments where the pump intake is located below the fluid inlet to the production vessel (e.g., such as inlet pipe 32 in FIG. 1, and perforations 53 in FIG. 2), the shroud 69 is not necessarily required but additionally provides the cooling advantage for the motor. Alternatively, a recirculating pump may be provided in the ESP to direct a portion of the fluid flow past the motor to provide additional cooling capacity.

Figure 3:
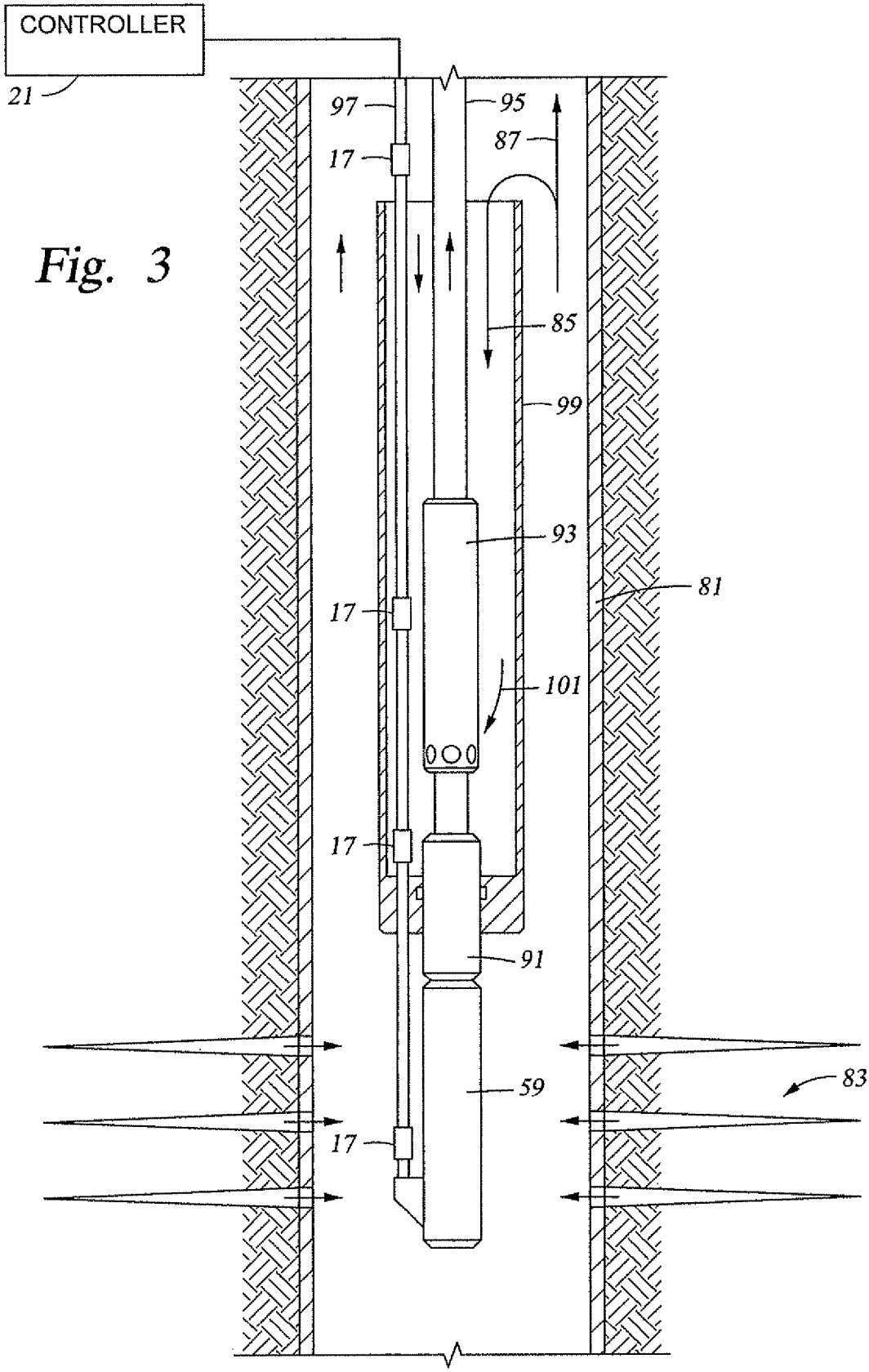
FIG. 3. is a schematic diagram of a third embodiment of an electrical submersible pump assembly for a production environment and is constructed in accordance with the invention.
Figure 4:
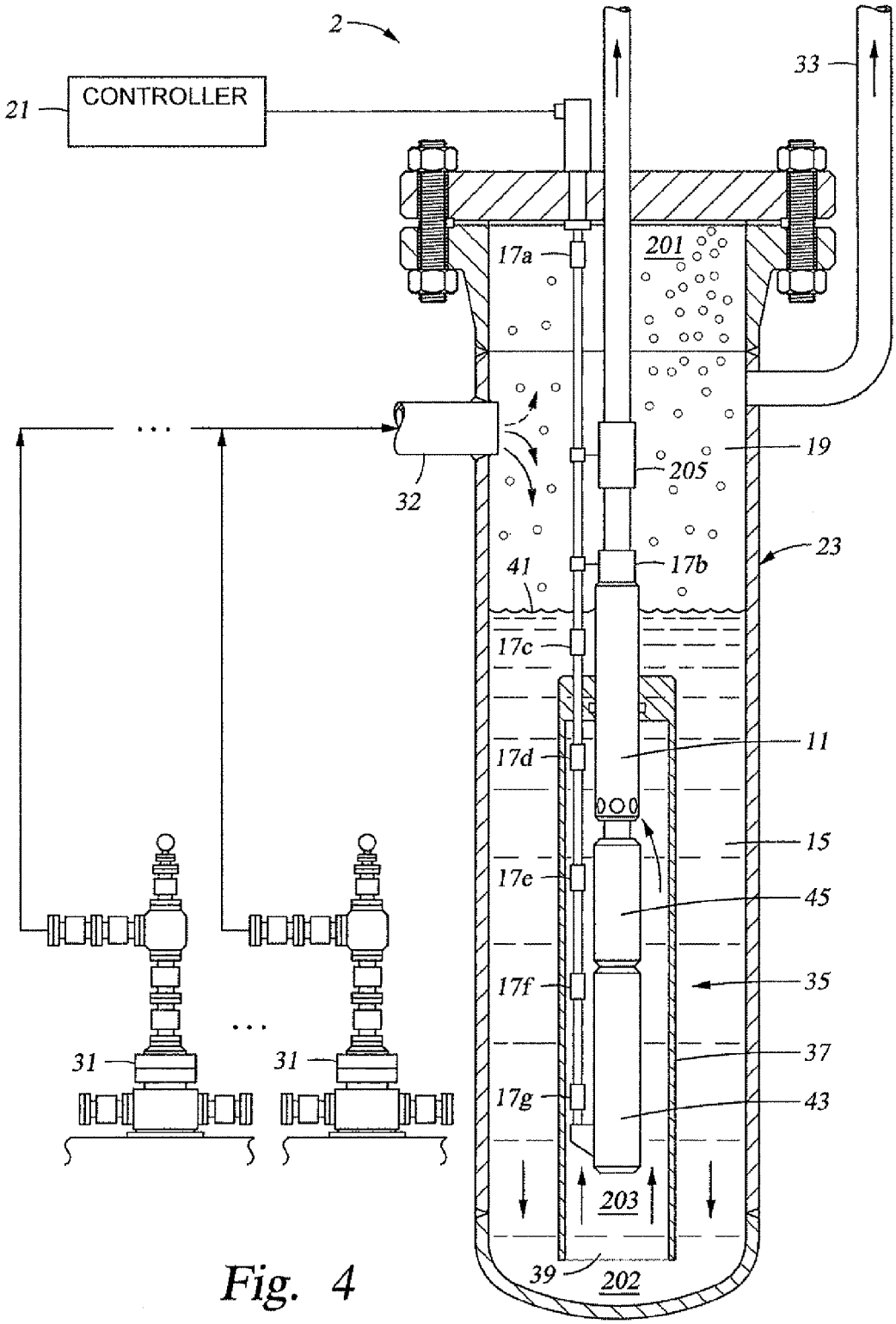
FIG. 4 is a schematic diagram of another embodiment of an electrical submersible pump assembly in accordance with the invention.
Figure 5:
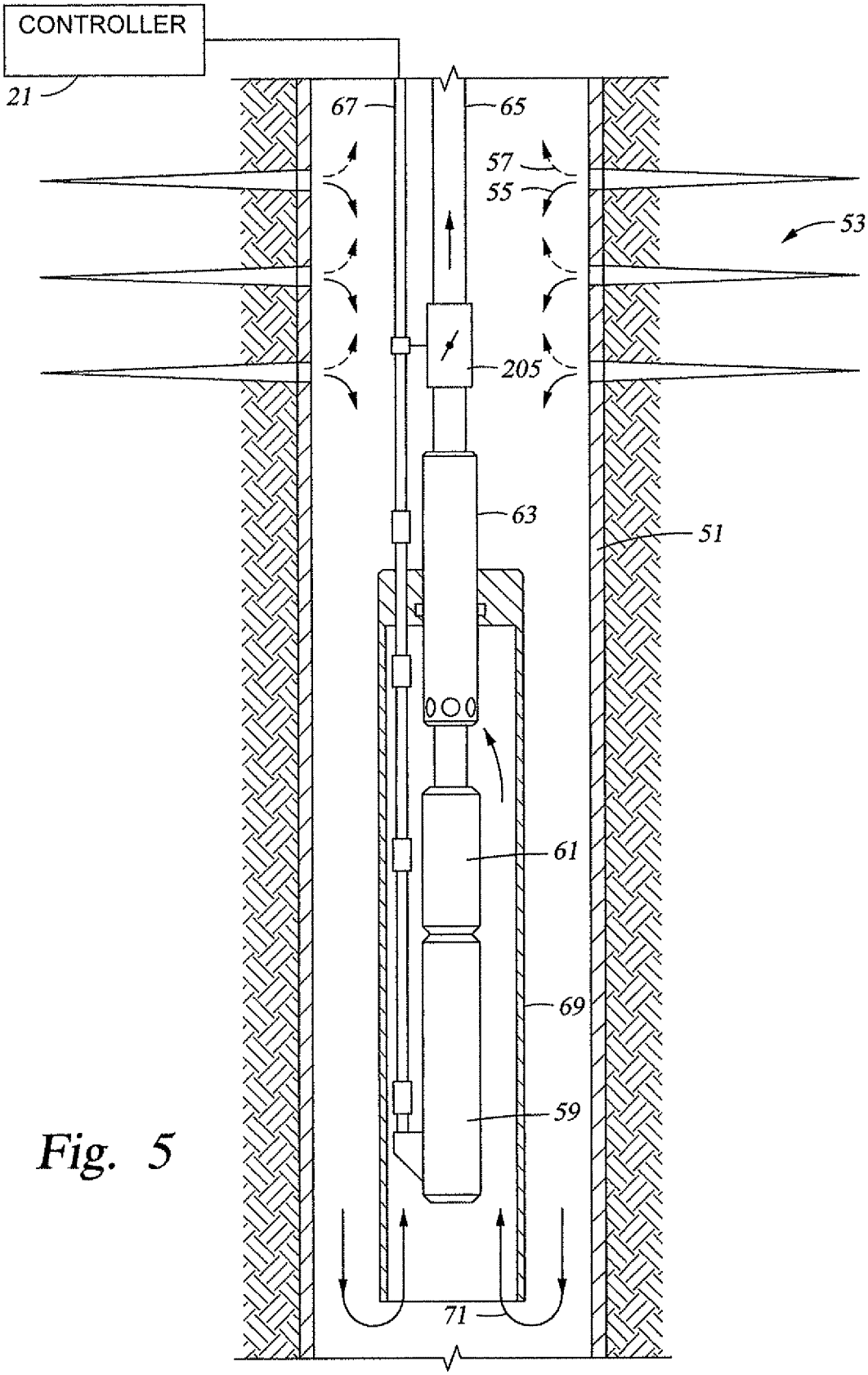
FIG. 5 is a schematic diagram of yet another embodiment of an electrical submersible pump assembly in accordance with the invention.
Figure 6:
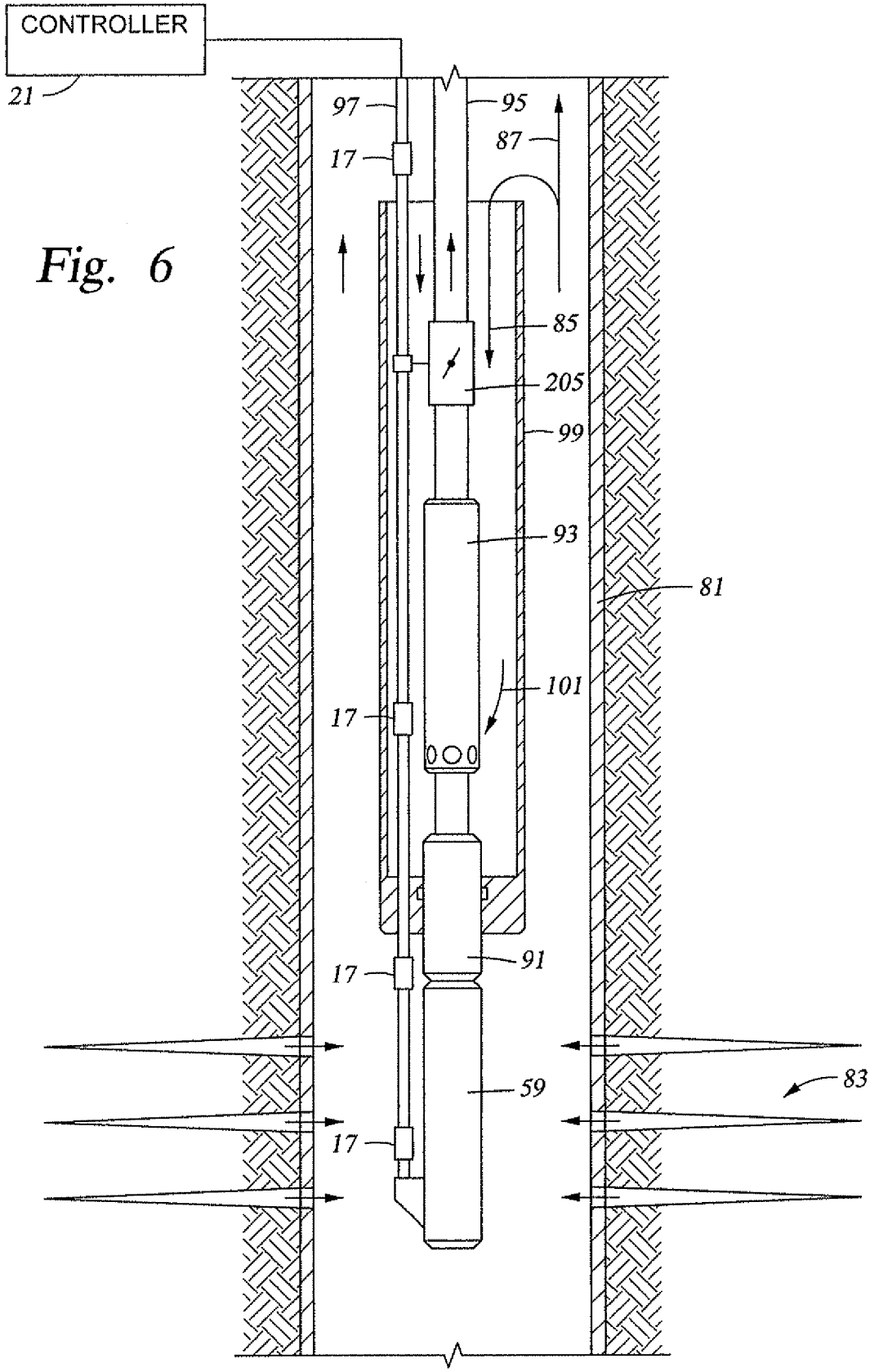
FIG. 6 is a schematic diagram of still another embodiment of an electrical submersible pump assembly in accordance with the invention.

Referring now to FIG. 3, a third embodiment of an electrical submersible pump assembly for a production environment is shown. Like the preceding embodiment, the well has well casing 81 with perforations 83 that permit a liquid flow 85 and a gas flow 87. However, the ESP assembly is located above perforations 83. The ESP assembly includes motor 59, seal 91 and pump 93, which are mounted to outlet pipe 95 with power provided by power cable 97.

At least a portion of the ESP assembly is located in an inverted shroud 99 (i.e., the open end is at the top of the shroud). Thus, in the embodiment shown, the shroud 99 is mounted below the pump 93, it extends upward past the pump, and it is open at an upper end thereof. The intake flow path 101 of liquids 85 to the pump 83 is defined by the shroud 99, which also directs the flow of gas 87 up past the ESP assembly. The liquids 85 are directed down inside the inverted shroud 99 while the gas 87 moves Up the well between the casing 81 and pipe 95 and discharges out of the casing vent at the surface.

The invention has numerous advantages. The pump intake is located in a production vessel such that the fluid flow comes to the pump intake from above so that there is a natural tendency for gas separation. The automated property measurement and control also permits the use of shorter and wider vessels compared to prior art monitoring methods. The prior art pressure transducer method currently used requires some difference in height between the various transducers in order to get the required resolution in a high pressure vessel. In contrast, the invention permits the pump to operate with a minimum fluid level over pump (FLOP). This design maximizes the gas slug capacity which further enables the capacity or size of the vessel to be reduced. The low FLOP allows the gas to be the highest quality possible with minimum entrained liquids.

While the invention has been shown or described in only some of its forms, it should be apparent to those skilled in the art that it is not so limited, but is susceptible to various changes without departing from the scope of the invention.

What is claimed is:

1. A system for controlling a pump in a well fluid production vessel, comprising:

a pump for pumping fluid from the production vessel, the pump having a fluid intake;

a single discharge conduit extending from the pump through which all of the well fluid pumped by the pump discharges;

means for separating gas from the well fluid upstream of the fluid intake;

a choke located in the discharge conduit;

a sensor located adjacent the pump for sensing a relative proportion of gas in the well fluid; and a controller coupled to the sensor and the choke to control a flow rate of the pump responsive to the proportion of gas in the well fluid sensed by the sensor.

2. A system according to claim 1, wherein the sensor is located at one of the discharge conduit and a fluid intake area relative to the pump.

3. A system according to claim 1, wherein the sensor comprises a plurality of sensors located at different positions along a fluid flow path relative to the pump.

4. A system according to claim 1, wherein the means for separating gas comprises a shroud that is sealed and mounted to the pump, the shroud extending downward past the pump, and the shroud being open at a lower end thereof.

5. A system according to claim 1, wherein the means for separating gas comprises a shroud that is mounted below the pump, the shroud extending upward past the pump, and the shroud being open at an upper end thereof.

6. A system according to claim 1, wherein the controller is located exterior of the production vessel.

7. A system according to claim 1, wherein the means for separating gas comprises a shroud that surrounds the fluid intake of the pump and has an open end.

8. A well fluid production system for producing well fluid containing a liquid and a gas from a well fluid production vessel, comprising:

an electrical submersible pump (ESP) assembly adapted to be installed in the production vessel for pumping the well fluid out of the production vessel, the ESP assembly having a shroud with an opening that provides access to the well fluid, the shroud causing separation of at least some of the gas from the well fluid as the well fluid enters the opening; the ESP assembly comprising:

a motor, a seal section and a pump having a fluid intake located inside the shroud, the fluid intake being within the shroud downstream from the opening;

a single discharge conduit extending from the pump through which all of the well fluid pumped by the pump discharges;

a choke located in the discharge conduit of the pump;

a sensor for sensing a relative proportion of gas in the well fluid; and a controller coupled to the sensor and the choke for regulating a flow rate of the pump in response to the proportion of gas sensed by the sensor.

9. A system according to claim 8, wherein the controller is adapted to be located exterior of the production vessel.

10. A system according to claim 8, wherein the sensor is located at one of the discharge conduit and a fluid intake area relative to the pump.

11. A system according to claim 8, wherein the sensor comprises a plurality of sensors located at different positions along a fluid flow path relative to the ESP assembly.

12. A system according to claim 8, wherein the shroud is sealed and mounted to the pump, the shroud extending downward past the pump, and the opening being at a lower end of the shroud.

13. A system according to claim 8, wherein the shroud is mounted to the motor, the shroud extending upward past the pump, and the opening being at an upper end of the shroud.

14. A method for producing a well fluid containing gas and liquid from a production vessel, the method comprising:

(a) providing a pump assembly comprising: a motor, a seal section, a pump having a fluid intake, a single discharge conduit, means for separating gas from the well fluid, a single discharge conduit extending from the pump, and a choke located in the single discharge conduit;

(b) receiving the well fluid into the production vessel, separating gas from the well fluid, then flowing the well fluid to the fluid intake and pumping all of the well fluid flowing in the fluid intake through the choke and the single discharge conduit out of the production vessel;

(c) sensing a relative proportion of gas in the well fluid; and (d) with the choke, modifying a flow rate of the pump in response to the relative proportion of gas in the well fluid sensed.

15. A method according to claim 14, wherein step (c) comprises sensing a density of the well fluid and step (d) comprises changing the flow rate of the pump responsive to density measurements.

16. A method according to claim 14, wherein the production vessel is a well having casing, the casing is perforated, and the pump is located either above or below the perforations, and wherein step (c) comprises sensing the relative proportion of gas in the well fluid at one of a fluid discharge area and a fluid intake area relative to the pump.

17. A method according to claim 14, wherein step (c) comprises sensing the proportion of gas in the well fluid at a plurality of locations along a fluid flow path relative to the pump.

18. A method according to claim 14, wherein the means for separating gas comprises a shroud sealed and mounted to the pump, the shroud extending downward past the pump, and the shroud having an opening at a lower end thereof.

19. A method according to claim 14, wherein the means for separating gas comprises a shroud mounted below the pump, the shroud extending upward past the pump, and the shroud having an opening at an upper end thereof.

20. A method according to claim 14, wherein the production vessel comprises a sea floor caisson, and step (b) comprises flowing well fluid into an upper portion of the caisson.

* * * * *